US005105118A

United States Patent [19]

Shinada et al.

[11] Patent Number: 5,105,118

[45] Date of Patent: Apr. 14, 1992

[54] RING-SHAPED GLASS BULB AND LAMP ASSEMBLY USING THE SAME

[75] Inventors: Hidehiro Shinada; Nobuyoshi Hatae; Takashi Tanabe, all of Kanagawa, Japan

[73] Assignee: Kabushiki Kaisha Toshiba, Kawasaki, Japan

[21] Appl. No.: 582,782

[22] Filed: Sep. 14, 1990

Related U.S. Application Data

[63] Continuation of Ser. No. 213,828, Jun. 30, 1988, abandoned.

[30] Foreign Application Priority Data

Jul. 1, 1987 [JP] Japan ..... 62-164603
Jul. 1, 1987 [JP] Japan ..... 62-164607

[51] Int. Cl.[5] ..... H01K 1/24; H01K 1/28; H01K 1/46

[52] U.S. Cl. ..... 313/51; 313/315; 313/318; 313/578; 313/634; 362/216; 439/229

[58] Field of Search ..... 313/634, 318, 279, 522, 313/51, 578, 315; 439/227, 229, 232; 362/216; 338/234, 237

[56] References Cited

U.S. PATENT DOCUMENTS

| | | | |
|---|---|---|---|
| 747,212 | 12/1903 | O'Brien | 313/522 |
| 1,651,287 | 11/1927 | Mayer | 313/279 |
| 2,366,252 | 1/1945 | Geiger | 439/229 X |
| 2,733,417 | 1/1956 | Hinman et al. | 439/229 |
| 3,189,778 | 6/1965 | Brundige | 313/279 X |
| 4,323,761 | 4/1982 | Hubner | 219/377 |

*Primary Examiner*—Palmer C. DeMeo
*Attorney, Agent, or Firm*—Oblon, Spivak, McClelland, Maier & Neustadt

[57] ABSTRACT

A ring-shaped glass bulb includes a ring-shaped light permeable hollow body having opposite ends each disposed at a prescribed distance from one to the other, and a filament arranged in the hollow body of the bulb. The outer-most edge portion of the outer ring edge of one of the ends of the bulb is disposed at at least the intersecting point between an outer circumferential line extending from the outer-most edge portion of the outer ring edge of the other end of the bulb and a tangent line extending from the inner-most edge portion of the inner ring edge of the other end of the bulb. A desirable prescribed distance between the opposite ends of the bulb is equal to or greater than 30 mm.

9 Claims, 6 Drawing Sheets

RING-SHAPED GLASS BULB AND LAMP ASSEMBLY USING THE SAME

This application is a continuation of application Ser. No. 07/213,828, filed on June 30, 1988, now abandoned.

BACKGROUND OF THE INVENTION

1. Field of the invention

The present invention relates, in general, to a ring-shaped glass bulb including a coiled filament therein. In particular, the invention relates to the ring-shaped glass bulb which is used for lamp assemblies. Lamp assemblies are used for a heating apparatus; as a heating source, or a lighting apparatus; as a light source.

2. Description of the related art

Lamp assemblies which radiate infrared rays are well known as a heating source of heating apparatus, e.g., electric stove, electric foot warmer, etc. Such an infrared ray radiating lamp typically includes a straight-shaped glass bulb wherein a filament is arranged along the elongated axis of the glass bulb. In this conventional infrared ray radiating lamp, a relatively long glass bulb is needed if the heating output of the lamp is increased. However, the increase in the length of the lamp may be restricted because of a limited space of the apparatus to which the lamp is arranged. To achieve a desired heating output in the conventional lamp, a plurality of straightshaped lamps are arranged parallel to one another. However, in this arrangement, the structure of the lamp may be complicated, and a desirable external shape of the apparatus may not be obtained.

To solve the above-described problems, the inventors of the present invention developed an infrared ray radiating lamp using a ring-shaped glass bulb wherein a coiled filament is arranged. This infrared ray radiating lamp uses a bulb material having a high temperature resistance, such as, e.g., quartz, hard glass, etc. Each end of the glass bulb at which a lead from the filament is respectively disposed is pinched to seal the bulb.

However, in this ring-shaped glass bulb, the problems which do not occur in the straight-shaped glass bulb occur when the filament is inserted into the bulb from one of the ends of the bulb, or when air in the bulb is exhausted. When the filament is inserted into the ring-shaped glass bulb from one of the ends of the bulb, the other end of the bulb opposite to the one end thereof may interfere with the filament. In particular, if a coiled filament includes a plurality of anchor portions having a relatively large external diameter, the anchor portion may be blocked by the end of the bulb when the distance between the opposite ends of the bulb is relatively small, resulting in the deformation of the filament. Furthermore, a special shaped exhausting nozzle is required to prevent the nozzle from contacting the other end of the bulb when the nozzle is inserted into the bulb from the one end of the bulb.

On the other hand, since a high temperature resistance glass material is used for the glass bulb, it is difficult to form a glass material into a desirable ring-shape. Therefore, the difference in the configuration of the opposite end portions of the bulb and variation in the dimension thereof should be taken into consideration to adapt a cap structure to the opposite end portions of the bulb.

SUMMARY OF THE INVENTION

It is an object of the present invention to provide an improved ring-shaped glass bulb into which a coiled filament is smoothly inserted.

It is another object of the present invention to provide an improved lamp assembly which uses a ring-shaped glass bulb.

To accomplish the above objects, according to one aspect of the present invention, a ring-shaped glass bulb includes a ring-shaped light permeable bulb which has a hollow body and opposite ends each disposed at a prescribed distance from one to the other, and a filament arranged in the hollow body of the bulb. One of the ends of the bulb has inner and outer ring edges, and the other end of the bulb has an outer ring edge. The outermost edge portion of the outer ring edge of the other end of the bulb is disposed at at least the intersecting point between an outer circumferential line extending from the outer-most edge portion of the outer ring edge of the one of the ends of the bulb and a tangent line extending from the inner-most edge portion of the inner ring edge of the one of the ends of the bulb. The prescribed distance between the opposite ends of the bulb may be equal to or greater than 30 mm.

According to another aspect of the present invention, the opposite ends of the ring-shaped bulb are pinched. A cap structure is attached to the opposite pinched ends of the bulb to form a lamp assembly. The cap structure may include one curved support element which has opposite ends each having a substantially channel-shaped bulb support portion at which each pinched end portion of the bulb is supported.

BRIEF DESCRIPTION OF THE DRAWING

The present invention is best understood with reference to the accompanying drawings, wherein like reference numerals throughout the various figures denote like structure elements and wherein.

DETAILED DESCRIPTION OF THE PREFERRED EMBODIMENT

Figure 1:
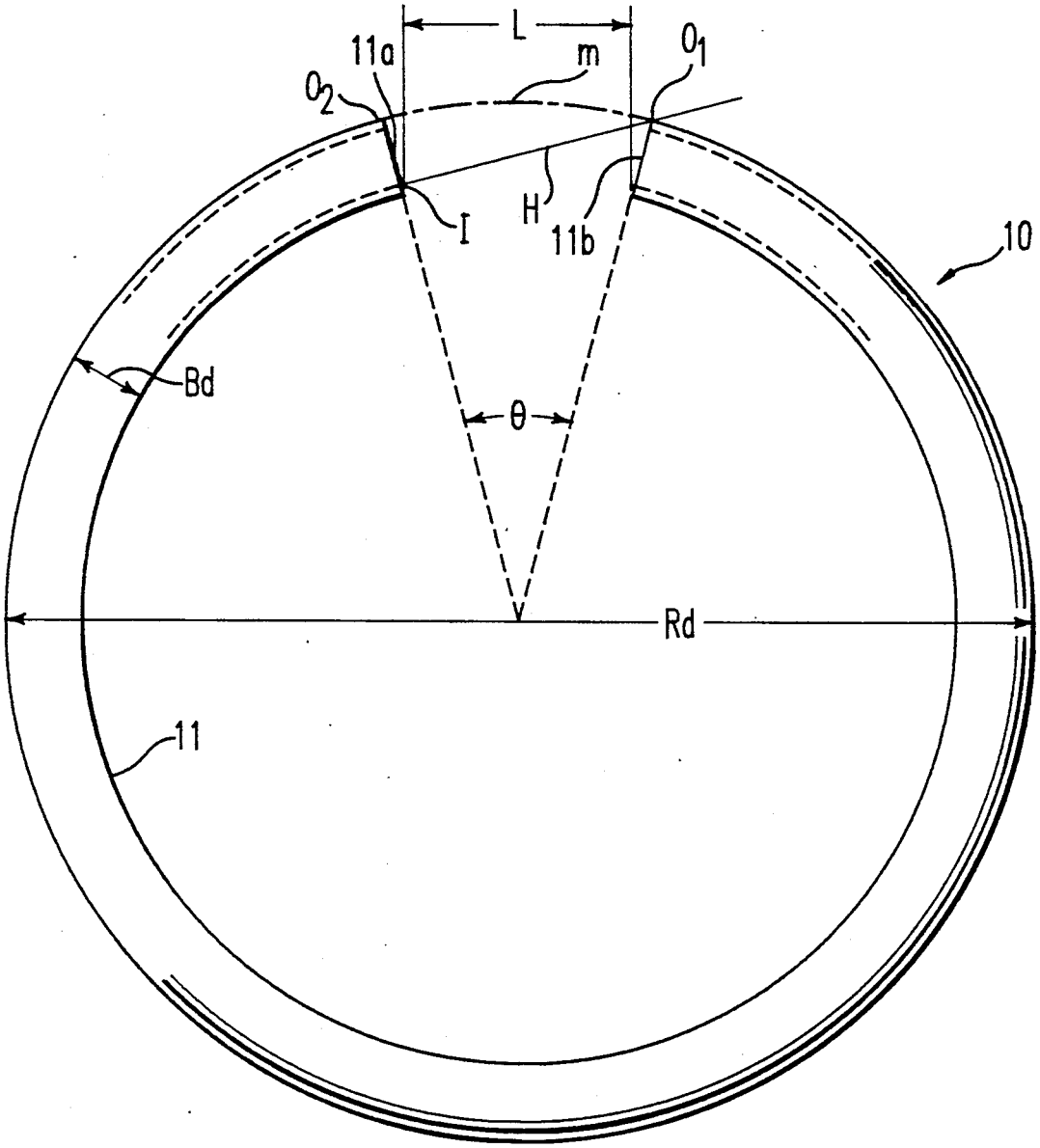
FIG. 1 is a plan view illustrating a ring-shaped glass bulb of one embodiment of the present invention.

A preferred embodiment of the present invention will now be described in greater detail with reference to the accompanying drawings. As shown in FIG. 1, a lamp structure 10 includes a ring-shaped bulb 11 made of quartz glass. Bulb 11 may be made of a hard glass, such as, e.g., borosilicate glass, aluminasilicate glass, etc. Bulb 11 has an outer diameter Bd of 11 mm. The ring diameter Rd of ring-shaped bulb 11 is 150 mm or 200 mm when bulb 11 is used for a heating apparatus of 800 W rating. One end 11*a* of bulb 11 is opposite to the other end 11*b* of bulb 11 at a prescribed distance L. The outermost portion $O_1$ of the outer ring edge of the other end 11*b* of bulb 11 is disposed at an intersecting point between an outer circumferential curved line m extending from the outer-most portion $O_2$ of the outer ring edge of the one end 11*a* of bulb 11, indicated by a dot and dashed line in FIG. 1, and a tangent line H extending from the innermost portion I of the inner ring edge of the one end 11*a* of bulb 11, indicated by a solid line. The outermost portion $O_1$ of the outer ring edge of the other end 11*b* of bulb 11 may be located a short distance from the intersecting point described above. A minimum value Lmin of the distance L obtained by the above-described manner is about 30 mm when bulb 11 has a ring diameter Rd of 150 mm, a bulb diameter Bd of 11 mm, and a bulb thickness of 0.8 mm. When the ring diameter Rd is 200 mm, the distance L rather increases above 30 mm.

Figure 2:
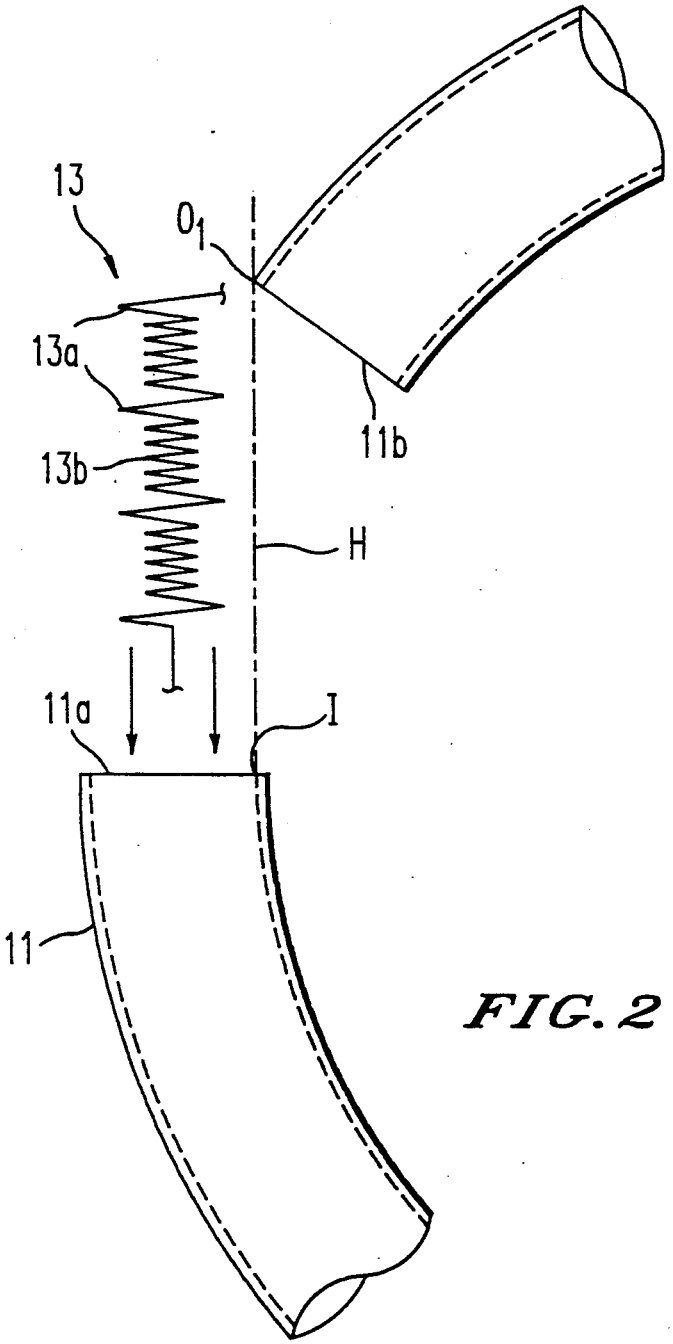
FIG. 2 is an enlarged plan view illustrating a part of the ring-shaped glass bulb of the one embodiment, shown in FIG. 1, which shows the positional relationship between the opposite ends of the ring-shaped glass bulb.
Figure 3:
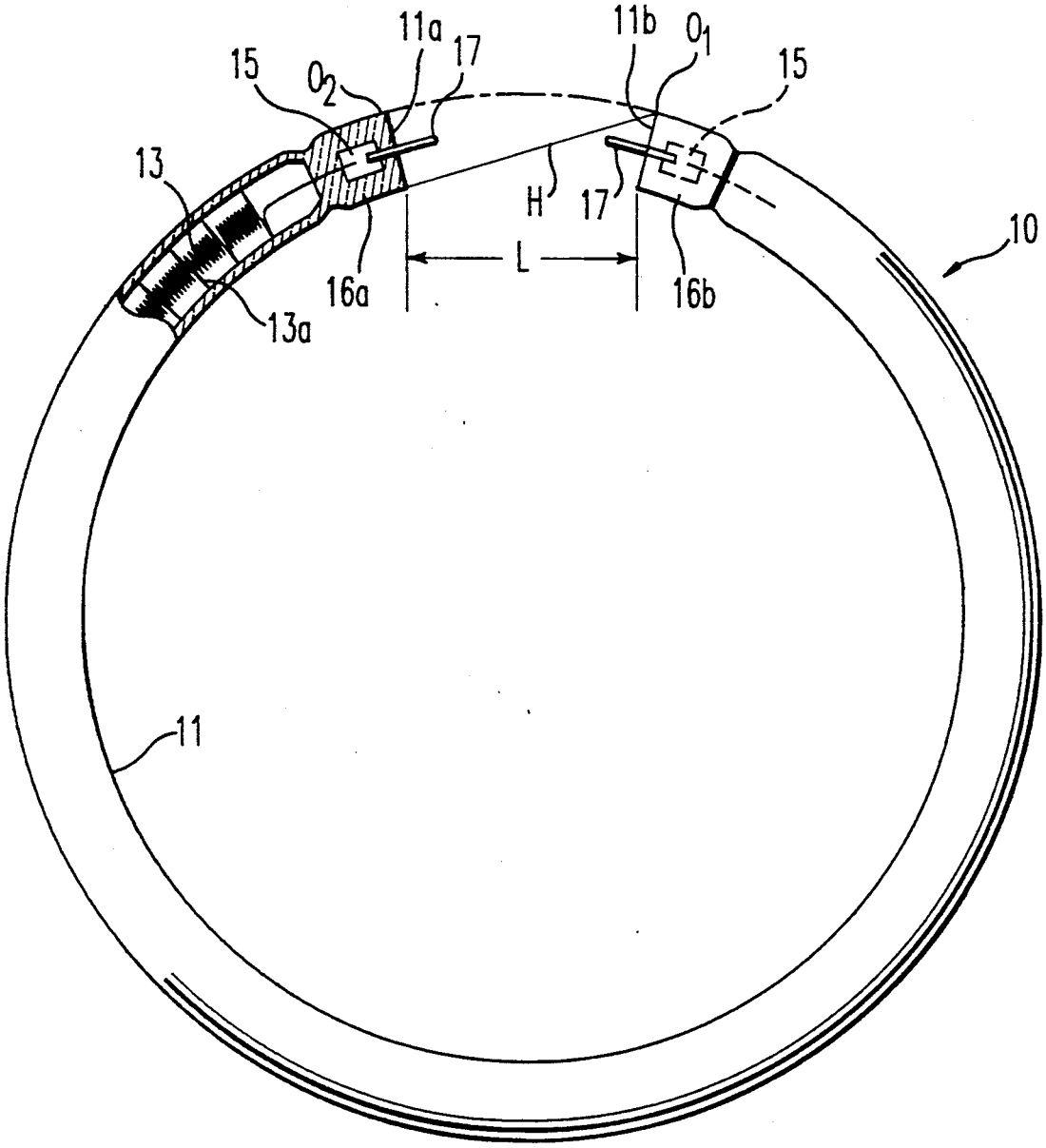
FIG. 3 is a plan view illustrating the ring-shaped glass bulb of the one embodiment in which a coiled filament is arranged and the opposite ends of the bulb are respectively pinched.

In the above-described structure, a coiled filament 13 is inserted into bulb 11 from the one end 11*a* of bulb 11, as shown in FIG. 2. Coiled filament 13 is formed with a tungsten wire or a molybdenum wire. Coiled filament 13 includes a plurality of anchor portions 13*a* regularly disposed at a predetermined interval. Each anchor portion 13*a* is coiled so as to be of a greater diameter than the remaining coiled portion 13*b* of filament 13. Therefore, a portion of the outer surface of each anchor portion 13*a* contacts the inner wall of bulb 11 to support filament 13 in bulb 11. When the above-described filament 13 is inserted into bulb 11 from the one end 11*a* of bulb 11, coiled filament 13 is smoothly inserted into bulb 13 even though filament 13 includes a plurality of anchor portions 13*a*. This is because the other end 11*b* of bulb 11 is not located in the direction of the tangent line H extending from the one end 11*a* of bulb 11 by maintaining distance L between the opposite ends 11*a* and 11*b* of bulb 11, as shown in FIG. 2. Rather, end 11*a* has an edge surface which substantially perpendicularly intersects tangent line H. After coiled filament 13 is arranged throughout ring-shaped bulb 11, air in bulb 11 is exhausted by an exhausting nozzle (not shown), and a predetermined inert gas, e.g., argon, is supplied to bulb 11. Opposite ends 11*a* and 11*b* of bulb 11 are heated by a heating device, e.g., burner, (not shown), and are respectively pinched or closed by a suitable tool, e.g., a pincher (not shown) when the temperature of each end 11*a*, 11*b* of bulb 11 reaches a prescribed softening temperature, as shown in FIG. 3. Molybdenum foils 15 are respectively disposed in the pinched portions 16*a* and 16*b* of bulb 11, as an electroconductive material. Each end of coiled filament 13 is connected to respective molybdenum foils 15. One end of an outer lead wire 17 is connected to respective molybdenum foils 15, and is supported by the pinched portion 16*a*, 16*b* of bulb 11. If bulb 11 is made of a hard glass, molybdenum wire or a tungsten wire may be used as the electroconductive material, instead of molybdenum foil 15.

In the above-described structure, distance L between opposite ends 11*a* and 11*b* of bulb 11 is maintained at least 30 mm. However, distance L may be selected from a practical range greater than 30 mm. However, if distance L is extremely large, the difference in temperature or difference in illuminance in the circumferential direction of bulb 11 increases. Therefore, a maximum value Lmax of distance L is determined as a practical value. The maximum value Lmax of distance L is about 70 mm when the ring diameter Rd of bulb 11 is 200 mm. However, the maximum value Lmax of distance L depends on the ring diameter Rd of bulb 11. Therefore, if the range of the maximum value Lmax is expressed by the opening angle $\theta$ at the center of bulb 11 shown in FIG. 1, a desirable range is 27°~40°.

Figure 4:
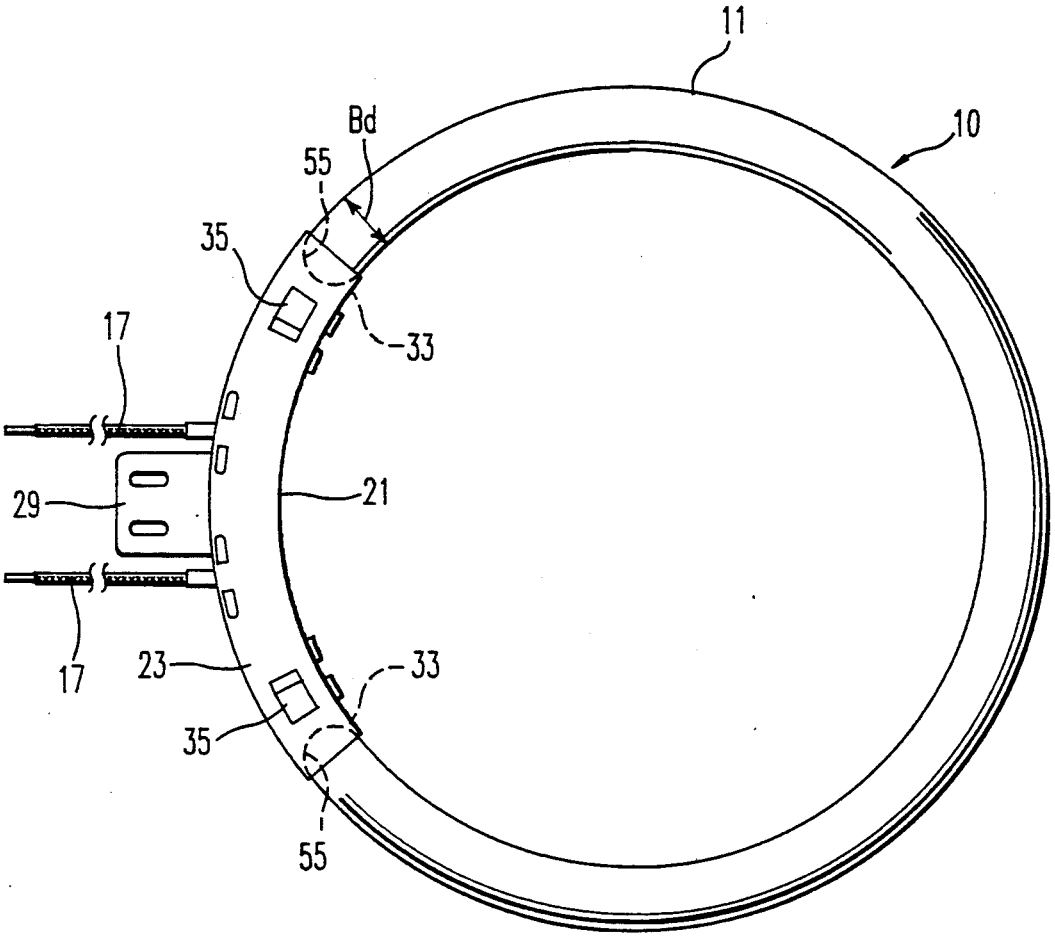
FIG. 4 is a plan view illustrating the ring-shaped glass bulb, shown in FIG. 3, with a cap structure.
Figure 5:
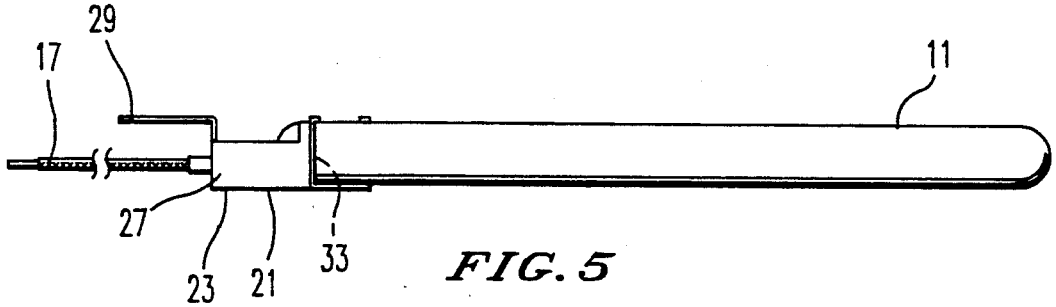
FIG. 5 is a side view illustrating the ring-shaped glass bulb with the cap structure shown in FIG. 4.
Figure 6:
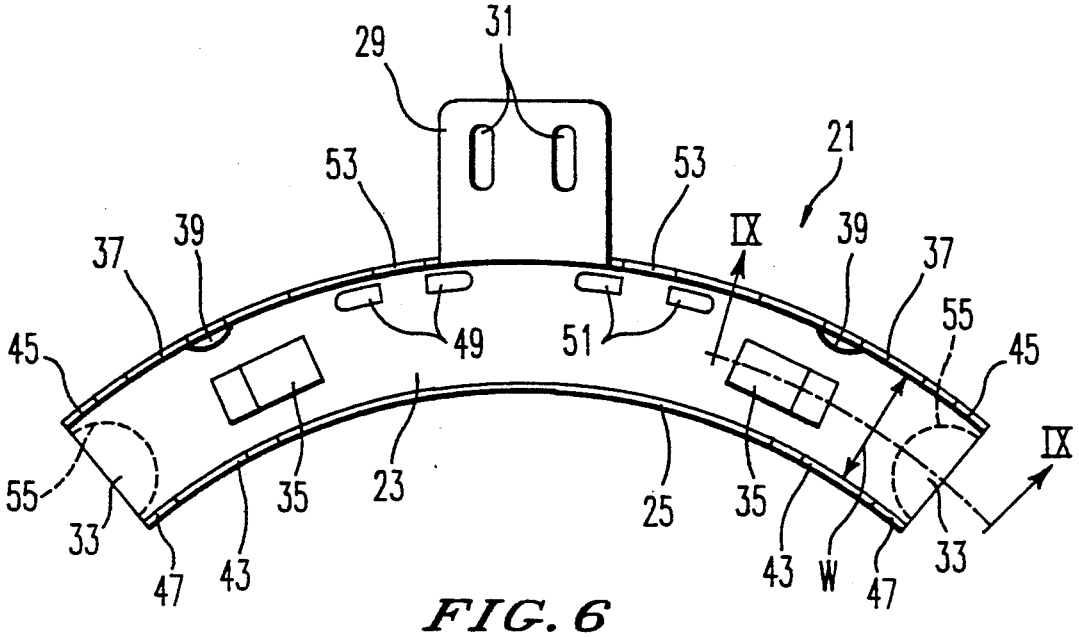
FIG. 6 is a plan view illustrating the cap structure shown in FIGS. 4 and 5.
Figure 10:
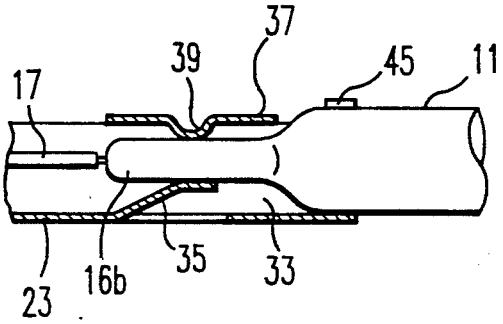
FIG. 10 is a cross sectional view illustrating the bulb support portion of the cap structure shown in FIG. 9 when the pinched end of bulb is supported by a holding plate of the cap structure.
Figure 11:
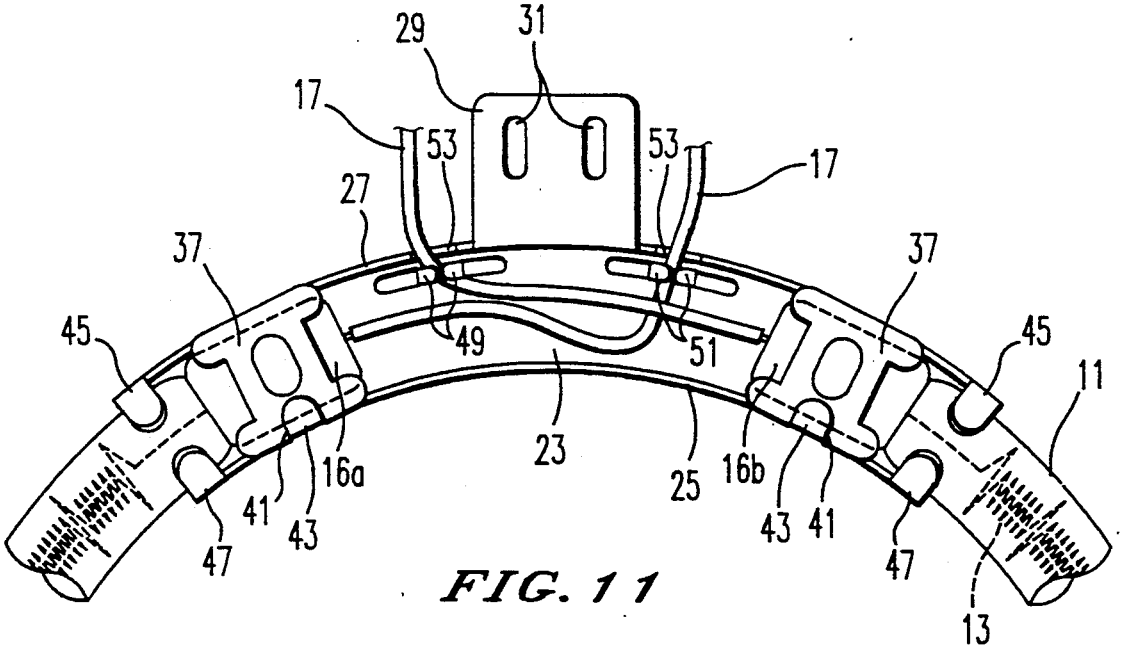
FIG. 11 is a plan view illustrating the cap structure with the opposite ends of the bulb when the opposite ends of the ring-shaped bulb is supported by the cap structure.

As shown in FIG. 4, an arc-shaped cap structure 21 is attached to ring-shaped bulb 11. Arc-shaped cap structure 21 is formed by one steel plate. Cap structure 21 includes a curved flat base plate 23, inner and outer walls 25 and 27 substantially perpendicularly extending from respective elongated outer and inner side edges of base plate 23, and a bracket 29 outwardly projecting from the top of outer wall 27 at the middle of cap structure 21 in an elongated direction of cap structure 21, as shown in FIGS. 5 and 6. A pair of holes 31 are opened at bracket 29 to attach lamp structure 10 to an apparatus, e.g., electric stove, through bracket 29. A bulb support portion 33 is respectively formed at opposite ends of cap structure 21. Each end portion 11*a*, 11*b* of bulb 11 is respectively fit into corresponding bulb support portions 33. A portion of base plate 23 at each bulb support portion 33 is cut and bent to form a spring plate 35 respectively, as shown in FIGS. 6, 8, 9 and 10. A bendable holding plate 37 projects from the upper end portion of outer wall 27 at bulb support portion 33. A center portion of each holding plate 37 is depressed to form a convex holding portion 39 respectively. Holding portion 39 of each holding plate 37 is disposed opposite to spring plate 35 when holding plate 37 is bent at right angles. A notched portion 41 is formed at the top end portion of respective holding plates 37. A fixing pawl 43 projects upward from each end portion of inner wall 27 corresponding to notched portion 41 of each holding plate 37. A pair of auxiliary fixing pawls 45, 47 project parallel to fixing pawl 43 from respective end portions of inner and outer walls 25 and 27 in an elongated direction. As shown in FIG. 6, two pairs of supporting pawls 49, 51 are respectively provided on base plate 23 close to bracket 29 to support each lead wire 17 extending from bulb 11. A pair of opening 53, 53 are respectively formed to outer wall 27 corresponding to each supporting pawl 49, 51 to pass each lead wire 17 therethrough. As shown in FIG. 11, one of lead wires, e.g., the lead wire extending from end portion 16*b* of bulb 11, intersects the other lead wire, and is supported by the left-hand side supporting pawls 49. Also, the other lead wire extending from end portion 16*a* of bulb 11 is supported by the right-hand side supporting pawls 52. After that, each lead wire passes through corresponding opening 53, 53 toward the outside of cap structure 21.

Figure 7:
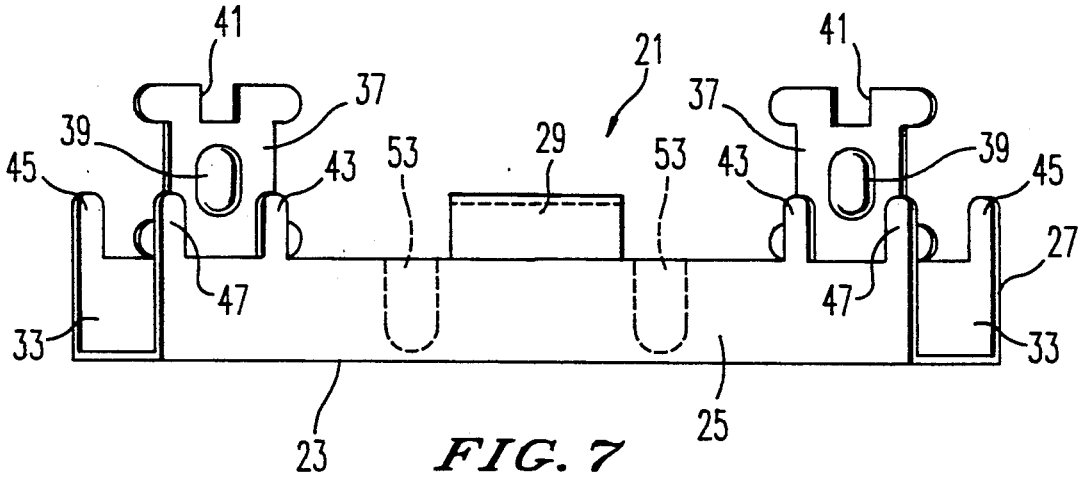
FIG. 7 is a front view illustrating the cap structure shown in FIG. 6.
Figure 8:
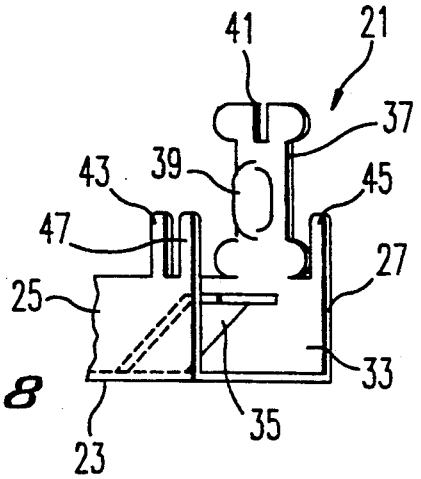
FIG. 8 is a segmental view illustrating a bulb support portion of the cap structure shown in FIGS. 6 and 7.
Figure 9:
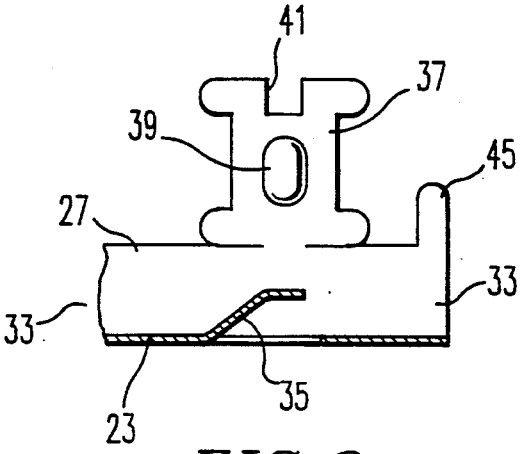
FIG. 9 is a cross sectional view taken on line IX—IX of FIG. 6.

As clearly seen in FIGS. 7 and 8, since cap structure 21 includes flat base plate 23 and inner and outer walls 25 and 27 perpendicularly extending from each side of base plate 23, a cross section of cap structure 21 is a rectangular shape. In particular, since bulb support portion 33 is defined by base plate 23, inner and outer walls 25 and 27, and holding plate 37 when holding plate 37 is bent, bulb support portion is formed in a rectangular-pipe shape. A width W between inner and outer walls 25 and 27 shown in FIG. 6 is greater than the outer diameter of bulb 11 at several mm.

The operation wherein cap structure 21 is attached to ring-shaped bulb 11 will be described hereafter. Pinched portions 16*a* and 16*b* (opposite ends 11*a* and 11*b*) of bulb 11 are respectively arranged to each bulb support portion 33. As shown in FIG. 11, each holding plate 37 is bent toward fixing pawl 43 at right angles. Each fixing pawl 43 is bent so that it is firmly fit into noched portion 41 of holding plate 37. Therefore, as shown in FIG. 10, each pinched portion 16*a*, 16*b* is held between spring plate 35 and convex holding portion 39 of holding plate 37 respectively. Each pinched portion 16*a*, 16*b* is elastically supported by a suitable repulsion force caused by the elastic deformation of spring plate 35. Each auxiliary fixing pawl 45, 47 is bent inward to fix bulb 11 to bulb support portion 33, as shown in FIG. 11. Each lead wire 17 extending from respective ends 11*a* and 11*b* of bulb 11 is crossed one to the other and is fixed by respective supporting pawls 49 and 51 to restrict the movement of each lead wire 17. Then, each lead wire 17 is led to the outside of cap structure 21 through corresponding opening 53, 53 of outer wall 27. When electric power is supplied to filament 13 in bulb 11 through lead wire 17, filament 13 radiates light with heat. The bulb wall temperature of ring-shaped bulb 11 increases at a prescribed level, e.g., 500°~600° C.

Figure 12:
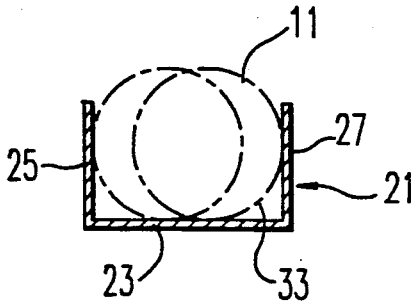
FIG. 12 is a schematic view illustrating the positional relationship between the cap structure and the ring-shaped bulb.

As stated before, variation in the location of each end portion 11*a*, 11*b* of bulb 11 occurs in each bulb support portion 33 because of the limited ability of a forming device, or heat expansion of bulb 11 during the operation, indicated by a dot and dashed line in FIG. 12 (the variation is emphasized in FIG. 12). Therefore, each end portion 11*a*, 11*b* may shift from a prescribed location within the width W of cap structure 21. However, in this embodiment, since each bulb support portion 33 of cap structure 21 is formed of a rectangular-shape, and the width W between inner and outer walls 25 and 27 is relatively greater than the outer diameter of bulb 11, each end portion 11*a*, 11*b* of bulb 11 is firmly supported in bulb support portion 33 of cap structure 21 even if a variation in the location of each end portion 11*a*, 11*b* of bulb 11 occurs. Furthermore, since cap structure 21 is formed by one piece of a metal plate, the manufacturing cost may be reduced. Furthermore, since each lead wire passes through the corresponding openings of the cap structure after crossing one to the other in the cap structure, a relatively long distance is maintained between the end portion of bulb and the corresponding opening. Therefore, each lead wire extending from the corresponding end portions is bent naturally so as to be passed through the corresponding openings of the cap structure. Excessive stress acting on each end portion of the bulb also is avoided.

In the above-described embodiment, an arcuate-cut portion 55 indicated by a dot and dashed line in FIG. 6 may respectively be formed in individual bulb support portions 33 of cap structure 21. Since at least a portion of the edge of each cut portion 55 contacts a curved portion 57 of each end portion 11*a*, 11*b* of bulb 11 adjoining to each pinched portion 16*a*, 16*b* when bulb 11 is pressed toward base plate 23 by bending auxiliary fixing pawls 45 and 47, bulb 11 is firmly supported by cap structure 21. Each cut portion 55 causes bulb 11 to increase the radiation of heat (light), and thus, the efficiency of lamp 10 increases. An increase in temperature of bulb support portion 33 is controlled because of cut portion 55, and thus, the heat deformation of auxiliary fixing pawls 45 and 47 and bulb support poriton 33 of cap structure 21 also decreases. Since the lamp assembly of this embodiment includes a ring-shaped bulb, the length of the bulb may be increased as compared with the external size (ring diameter) thereof. Compact external size and a high output both are achieved.

The lamp assembly of this invention which is used as a heat source has been described in the above-described embodiment. However, the lamp assembly of this invention may be used as a light source. Furthermore, the lamp assembly of this invention may be used both as light source and heat source.

The present invention has been described with respect to a specific embodiment. However, other embodiments based on the principles of the present invention should be obvious to those of ordinary skill in the art. Such embodiments are intended to be covered by the claims.

What is claimed is:

1. A ring-shaped bulb, comprising:

ring-shaped light permeable bulb means for transmitting light, the bulb means including a hollow body with opposite closed ends which are disposed at a prescribed distance from one to the other, one end of the bulb means having inner and outer ring edges, the other end of the bulb means having an outer ring edge, the outermost edge portion of the outer ring edge of the other end of the bulb being disposed at substantially an intersecting point between an outer circumferential line extending from the outermost edge portion of the outer ring edge of the one end of the bulb means and a tangent line extending from the innermost edge portion of the inner ring edge of the one end of the bulb means so as to form an opening angle of 27° to 40° with respect to a substantially center portion of the bulb means, the one end of the bulb means having an edge surface substantially perpendicularly intersecting the tangent line;

an elongated filament extending the length of and positioned within the bulb means; and a support member interconnecting said opposite ends of said bulb means.

2. A ring-shaped bulb according to claim 1, wherein the filament means includes a coiled element.

3. A ring-shaped bulb according to claim 2, wherein the hollow body of the bulb means has an inner diameter, the coiled element of the filament means including an anchor portion having a predetermined diameter substantially equal to the inner diameter of the hollow body of the bulb means for supporting the filament means in the hollow body of the bulb means.

4. A lamp assembly using a ring-shaped light-permeable bulb having a coiled filament therein and opposite closed ends, the ends being disposed at a prescribed distance equal to or greater than 30 mm therebetween so as to form an opening angle of 27°–40° with respect to a substantially center portion of said bulb, the lamp assembly comprising;

an elongate filament extending the length of the ring-shaped bulb;

cap means including one curved support element, the support element having opposite ends each having a substantially channel-shaped bulb support portion at which each closed end of the bulb is supported; and a pair of pawls extending from corresponding opposite ends of the support element for supporting a portion of the bulb adjoining the closed ends of the bulb.

5. A lamp assembly according to claim 4, wherein the curved support element includes a curved plate having inner and outer curved ends, and inner and outer walls substantially perpendicularly extending from the corresponding curved ends.

6. A lamp assembly according to claim 5, wherein the curved support element further includes a bracket plate extending from substantially center portion of the wall in an elongated direction for supporting the lamp assembly to an appratus.

7. A lamp assembly using a ring-shaped light-permeable bulb having a coiled filament therein and opposite closed ends each being disposed at a prescribed distance equal to or greater than 30 mm therebetween, the lamp assembly comprising;

cap means including one curved support element, the support element having opposite ends each having a substantially channel-shaped bulb support portion at which each closed end of the bulb is supported, wherein the curved support element includes a curved plate having inner and outer curved ends, and inner and outer walls substantially perpendicularly extending from the corresponding curved ends wherein the curved support element further includes a bendable holding plate extending from one of the inner and outer walls at the bulb support portion, and a spring plate disposed on the curved plate at the bulb support portion for supporting the closed end of the bulb between the holding plate and the spring plate when the holding plate is bent toward the spring plate.

8. A lamp assembly using a ring-shaped light-permeable bulb having a coiled filament therein and opposite closed ends each being disposed at a prescribed distance equal to or greater than 30 mm therebetween, the lamp assembly comprising;

cap means including one curved support element, the support element having opposite ends each having a substantially channel-shaped bulb support portion at which each closed end of the bulb is supported, wherein the curved support element includes a curved plate having inner and outer curved ends, and inner and outer walls substantially perpendicularly extending from the corresponding curved ends wherein the curved support element further includes a bracket plate extending from a substantially center portion of the wall in an elongated direction for supporting the lamp assembly to an apparatus wherein the ring-shaped bulb has a pair of lead wires each extending from corresponding closed ends of the ring-shaped bulb, the curved support element including means for defining a pair of openings each disposed close to the bracket plate, each lead wire being crossed from one to the other and passed through the corresponding openings.

9. A lamp assembly using a ring-shaped light-permeable bulb having a coiled filament therein and opposite closed ends each being disposed at a prescribed distance equal to or greater than 30 mm therebetween, the lamp assembly comprising;

cap means including one curved support element, the support element having opposite ends each having a substantially channel-shaped bulb support portion at which each closed end of the bulb is supported wherein the support element includes means for defining a pair of arcuate-cut portions each disposed at respective bulb support portions, each closed end of the bulb being arranged to the corresponding arcuate-cut portions.

* * * * *